US007554064B1

(12) United States Patent
Fannin et al.

(10) Patent No.: US 7,554,064 B1
(45) Date of Patent: Jun. 30, 2009

(54) METHOD FOR SEALING ELECTRICAL HEATING ELEMENTS

(75) Inventors: Jackie G. Fannin, Brookshire, TX (US); Jack L. McClanahan, Montgomery, TX (US)

(73) Assignee: Gaumer Company, Inc., Houston, TX (US)

( * ) Notice: Subject to any disclaimer, the term of this patent is extended or adjusted under 35 U.S.C. 154(b) by 470 days.

(21) Appl. No.: 11/357,703

(22) Filed: Feb. 17, 2006

Related U.S. Application Data

(60) Provisional application No. 60/653,763, filed on Feb. 17, 2005.

(51) Int. Cl.
*H05B 3/44* (2006.01)
*H01B 7/00* (2006.01)

(52) U.S. Cl. ..... 219/544; 219/618; 219/624; 219/628; 219/630; 219/59.1; 219/67; 219/236; 219/243; 219/523; 219/534; 219/535; 219/541; 219/542; 392/489; 392/503; 427/58; 174/118; 174/116; 174/121 R; 174/17 SF

(58) Field of Classification Search ..... 219/618, 219/624, 628–30, 59.1, 67, 236, 243, 523, 219/534–5, 541–2, 544; 392/489, 503; 427/58; 174/118, 116, 121 R, 17 SF
See application file for complete search history.

(56) References Cited

U.S. PATENT DOCUMENTS 3,726,713 A * 4/1973 Hawk et al. ..... 427/58

* cited by examiner

*Primary Examiner*—Shawntina Fuqua
(74) *Attorney, Agent, or Firm*—Bracewell & Giuliani LLP

(57) ABSTRACT

An electrical resistance heater element has a metal tube containing an electrical resistance coil that is electrically insulated from the metal tube by magnesium oxide powder, the coil being bonded to a conductor pin that protrudes from an open end of the tube. The powder is sealed against moisture by placing at least the open end of the tube within a chamber and immersing the open end within liquid silicone. A gas is pumped into the chamber to pressurize the silicone sufficiently to cause some of it to encroach into the powder through the open end of the tube. The heater element is installed within a heat exchanger with the silicone remaining uncured.

19 Claims, 3 Drawing Sheets

METHOD FOR SEALING ELECTRICAL HEATING ELEMENTS

CROSS REFERENCE TO RELATED APPLICATION

This application claims priority to provisional application Ser. No. 60/653,763, filed Feb. 17, 2005.

FIELD OF THE INVENTION

This invention relates in general to heater elements for process heat exchangers and in particular to a method of conditioning heater elements to resist moisture.

BACKGROUND OF THE INVENTION

Heat exchangers with electrical resistance heater elements are commonly used for heating fluids in processing plants, such as chemical plants. Typically, a number of electrical resistance heater elements are located within a tank of the heat exchanger. Each heater element 21 comprises a metal tube containing a coiled resistance wire for generating heat as electrical current passes through it. The coiled wire is insulated from the metal tube by an insulation powder, which is typically magnesium oxide packed tightly within the tube surrounding the coiled wire. While magnesium oxide provides excellent electrical insulation, it is a desiccant, thus it attracts moisture from the surrounding atmosphere. The penetration of moisture reduces the ability of the insulation powder to insulate.

In the past, heater elements of this nature have been kept in low humidity rooms and/or baked in an oven with their ends open to drive off any moisture. Then, when ready for use, the heater element is mounted to a header plate and seals are placed over the open ends. For example, a liquid sealant may be poured over the open ends and cured. While these methods work, improving the resistance of the insulation is desirable.

SUMMARY

In this invention, a dielectric liquid is applied under pressure to the open ends of the tube to cause some of the liquid to encroach into the insulation powder. Preferably the dielectric liquid is substantially at room temperature while it is forced into the open end of the tube. In the preferred embodiment, the dielectric liquid is uncured liquid silicone, which remains uncured at the completion of the treatment. Also, the heater element is preferably baked in an oven prior to the step of applying the liquid silicone to the open ends.

The liquid silicone may be applied under pressure to the open ends in various manners. In one method, the open end of the heater tube, or alternately the entire heater tube, is placed within a chamber and immersed in the dielectric liquid. Gas is pumped into the chamber to apply the pressure to the liquid silicone.

DETAILED DESCRIPTION OF THE INVENTION

Figure 1:
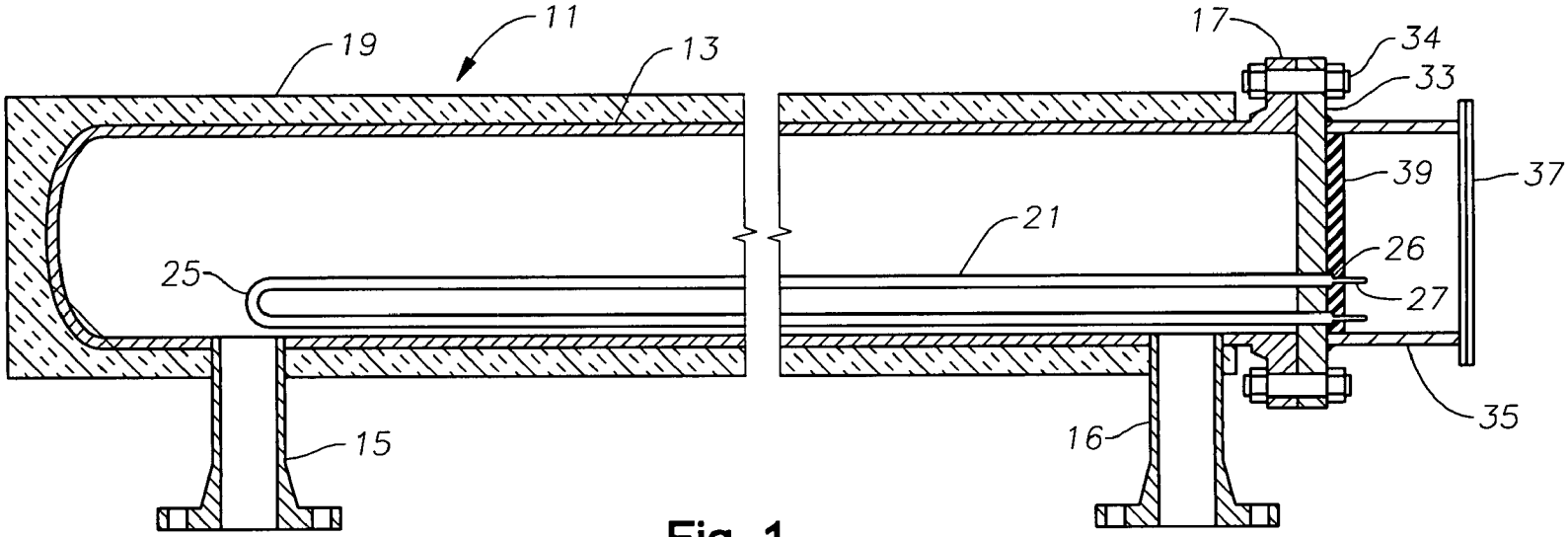
FIG. 1 is a schematic sectional view illustrating one type of a process circulation heater constructed in accordance with this invention, and showing only one of the heater elements.

Referring to FIG. 1, circulation heater 11 is of a conventional type used for heating fluids in processing plants, such as chemical plants, or for other heat exchanging uses. Heater 11 has a tank 13 that is generally cylindrical. Tank 13 has ports 15 and 16 on its sidewall near opposite ends for circulating a fluid through tank 13. One end of tank 13 is closed, and the other has an opening encircled by a flange 17. Thermal insulation 19 is typically located on the exterior of tank 13. Circulation heater 11 is shown as an example only, and it could be other types, such as a flanged heater or screw plug heater.

Figure 3:
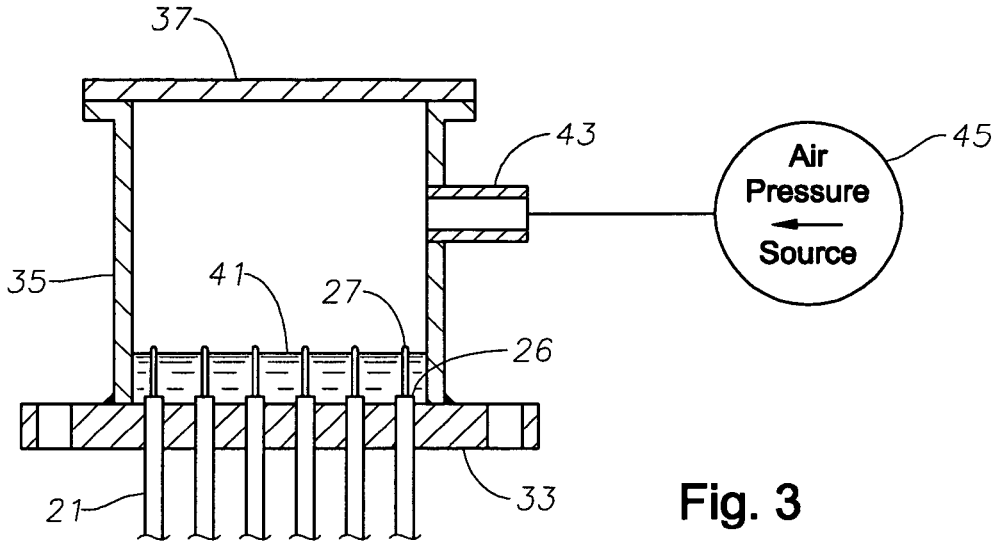
FIG. 3 is a sectional view of the header portion of the circulation heater of FIG. 1, with the heater tank removed, additional heater elements installed, and illustrating one step in the conditioning process.
Figure 4:
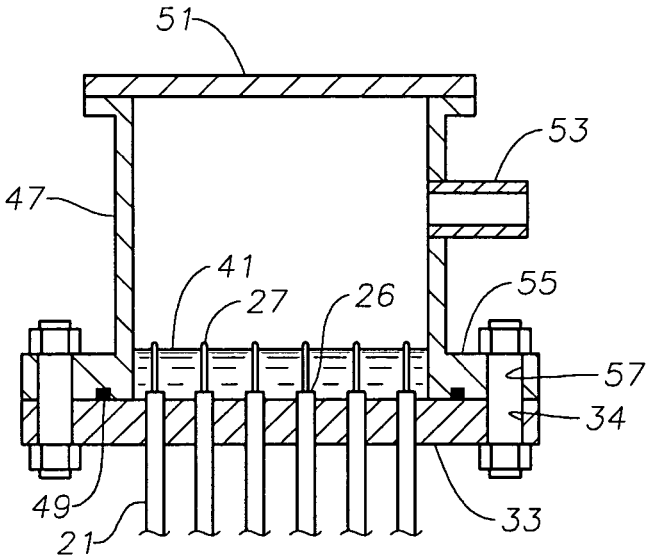
FIG. 4 is a view similar to FIG. 3, but illustrating the step of FIG. 3 in connection with a heater with a temporary installation housing.

A number of electrical resistance heater elements 21 are located within tank 13. In FIG. 1, only one of the heater elements 21 is shown, but normally a number of heater elements 21 would be utilized, as illustrated in FIGS. 3 and 4. Each heater element 21 comprises a metal tube or sheath 23, which in this example, is bent to form a U-shaped bend 25 and two open ends 26. An electrical connector pin 27 protrudes from each open end 26 of each heater element 21. Open ends 26 extend through mating holes provided in a header plate 33. Typically, each sheath 23 is brazed or welded to header plate 33. Header plate 33 has holes 34 circumferentially spaced around its outer edge for bolting header plate 33 to flange 17 of tank 13.

Figure 2:
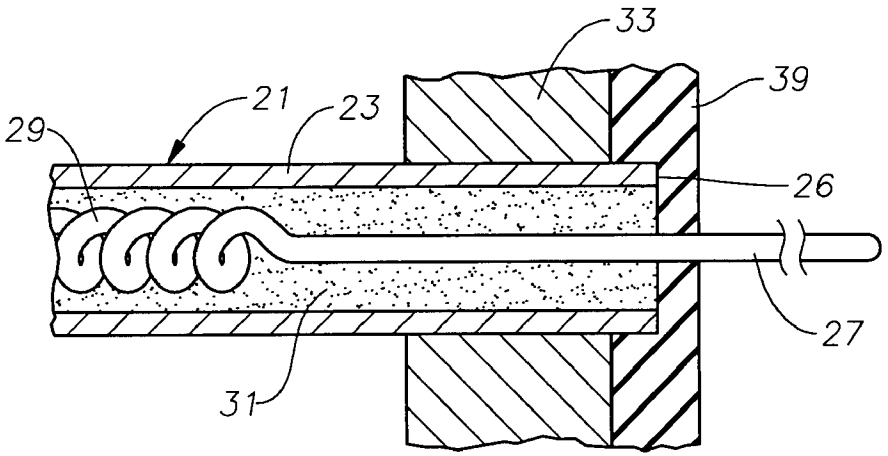
FIG. 2 is an enlarged sectional view of the connector pin portion of one of the heater elements of the circulation heater of FIG. 1.

As shown in FIG. 2, each connector pin 27 is an electrical conductor that is joined, as by brazing, to a coiled wire 29. Wire 29 has a high electrical resistance for generating heat as electrical current passes through it. Wire 29 extends continuously from one connector pin 27 through U-shaped bend 25 and to the other connector pin 27. A typical material for wire 29 is a nickel chromium alloy.

Coiled wire 29 is insulated from metal sheath 23 by an insulation powder 31. Insulation powder 31 is preferably magnesium oxide, and it is packed tightly within sheath 23 surrounding coiled wire 29. Prior to the complete assembly of heater element 21 to header plate 33, insulation powder 31 is exposed to atmosphere at open end 26. While magnesium oxide provides excellent resistance, it is a desiccant, thus it attracts moisture from the surrounding atmosphere. The penetration of moisture reduces the ability of insulation powder 31 to insulate. Utilizing a process to be described subsequently reduces the tendency of insulation 31 to attract moisture.

Referring again to FIG. 1, a cylindrical housing 35 is joined to header plate 33 and encloses connector pins 27. In this embodiment, housing 35 is welded to the outer side of header plate 33 surrounding connector pins 27, but it could be attached in other manners. In this example, housing 35 has an end cap 37 that is releasable. Some circulation heaters 11 have housings 35 that are sealed to atmosphere and capable of containing internal pressure up to a desired amount. Other housings 35 are open to atmosphere. Housing 35 is employed to protect the wires and connectors (not shown) that join connector pins 27. Various types of insulating boots may be secured over each open end 26 surrounding each connector pin 27.

In the example of FIG. 1, heater elements 21 have been processed or conditioned to retard moisture entry. Further, an optional layer of sealant 39, such as silicone, has been cured in place on header plate 33. Sealant 39 was poured on header plate 33 over the open ends 26 of heater elements 21, leaving only connector pins 27 exposed. Sealant 39 preferably cures at room temperature when exposed to air, and is allowed to cure after it is poured onto header plate 33.

The first step in conditioning or moisture-proofing heater elements 21 is to heat them for a sufficient amount time at a sufficient temperature to remove as much moisture as practical in insulation 31. This step is normally performed in an oven, and it may be done prior to or after assembly of heater elements 21 with header plate 33. Alternately, the removal of moisture step may be done both before and after assembly of heater elements 21 with header plate 33. Insulation 31 will be exposed to the atmosphere in the oven at open ends 26. Then, heater elements 21 may be attached to header plate 33, preferably by welding, brazing or staking open ends 26. Also, compression fittings may be used to attach heater elements 21 to header plate 33. In the example of FIG. 3, housing 35 is then welded to header plate 33.

Referring still to FIG. 3, housing 35 in this example is a pressure chamber containing type. A dielectric liquid 41 is poured on top of header plate 33 before applying any sealant 39 (FIGS. 1 and 2). A preferred dielectric is high dielectric uncured liquid silicone of a type that does not cure when exposed to air. The viscosity may vary widely, such as from 25 centipoise to 25000 centipoise. The level of silicone 41 could entirely immerse connector pins 27, but this is not necessary as long as it covers open ends 26 (FIG. 2) and comes into contact with insulation powder 31 of heater elements 21.

Housing 35 typically has a port 43, and this port is connected to an air pressure source 45, which applies air pressure to the interior of housing 35. No heat is required, and dielectric liquid 41 remains uncured. The amount and duration of the air pressure may vary, and typically is about 100 psi for five to ten minutes. The application of pressure to dielectric liquid 41 causes some of the liquid to enter insulation powder 31 (FIG. 2), filling and sealing the spaces between the individual grains of insulation powder 31. The amount of dielectric liquid 41 that actually enters open ends 26 is small, typically only migrating about 0.5 to 2.0 inches inward into insulation powder 31. Often, the extent of migration is about 0.75 inch. After dielectric liquid 41 has migrated the typical distance, it tends to plug up insulation powder 31 and not migrate any further, regardless of the amount of time air pressure is applied. Dielectric liquid 41 may reach its full penetration depth in less than five minutes. Dielectric liquid 41 does not cure after entering insulation 31, rather remains a liquid.

After a sufficient time under pressure is reached, air pressure source 45 is disconnected and the excess dielectric liquid 41 removed from header plate 33. It is not necessary to thoroughly clean dielectric liquid 41 from header plate 33 and open ends 26. If desired, sealant layer 39 (FIG. 1) may then be poured and cured around connector pins 26.

FIG. 4 shows a method that is applicable for housings 35 (FIG. 3) that will not contain pressure. In this method, after heater elements 21 are welded into header plate 33 and before welding housing 35 to header plate 33, an installation fixture or housing 47 is temporarily connected to header plate 33. Installation chamber or housing 47 has an annular seal 49 that seals its face to header plate 33 at a point surrounding heater element open ends 26 and radially inward from bolt holes 34. Installation housing 47 has a cap 51 and a port 53. Installation housing 47 may be secured to header plate 33 in different manners. In this example, installation housing 47 has a flange with holes 57 that align with holes 34 in header 33 for receiving bolts. Once secured, the operator introduces dielectric liquid 41, closes cap 51 and applies pressure through air pressure source 45 (FIG. 3) and port 53. After pressure has been applied for the desired amount of time, the operator removes dielectric liquid 41 and unbolts installation housing 47 from header plate 33. Permanent housing 35 will then be attached in a conventional manner, such as by welding.

Figure 5:
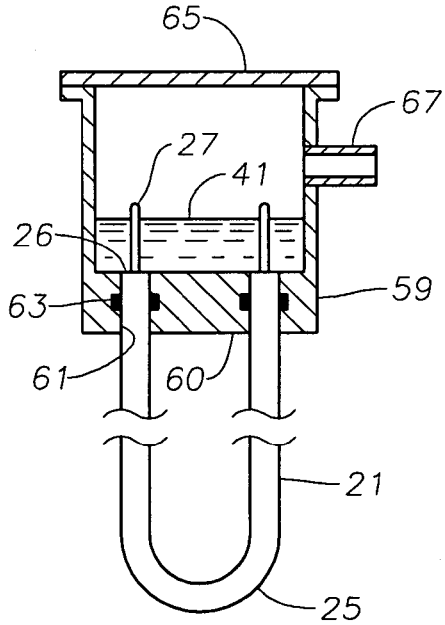
FIG. 5 is a schematic sectional view illustrating another method of conditioning the heater elements of the circulation heater of FIG. 1.

Some heater units do not employ heater elements welded to a header plate as described above. FIG. 5 shows one method for utilizing this process without a header plate 33 (FIG. 1). A chamber or housing 59 is utilized that has holes 61 for receiving one or more heater elements 21 (only one shown in FIG. 5). Chamber 59 has a base 60 with holes 61, each receiving one of the open ends 26 of a heater element 21. A seal 63 for each hole 61 seals around sheath 23. Chamber 59 has a cap 65 for access and a port 67 for application of air pressure. Dielectric liquid 41 is placed on chamber base 60 in the same manner as in connection with the other embodiments. Air pressure is applied through port 67 to dielectric liquid 41 for a selected time. Subsequently, heater element 21 is removed from chamber 47 and mounted to a heater assembly.

Figure 6:
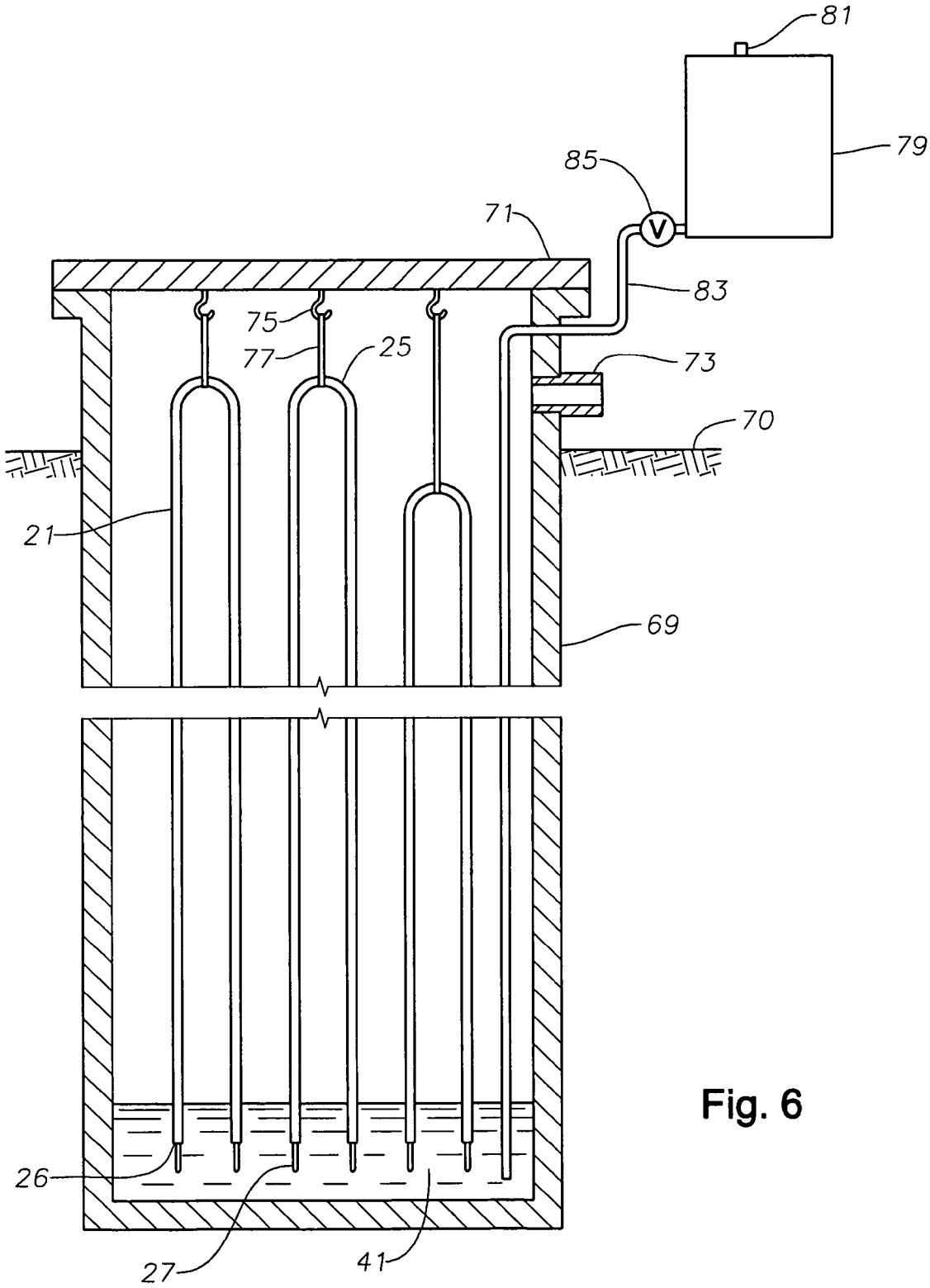
FIG. 6 is a schematic sectional view illustrating another method of conditioning the heater elements of the circulation heater of FIG. 1.

FIG. 6 discloses still another method of conditioning individual heater elements 21 prior to installation into a heater assembly. In FIG. 6, a pressure chamber 69 is constructed for holding one or more heater elements 21. For safety, pressure chamber 69 may be located within a vertical hole with a substantial portion below ground level 70. In one example, pressure chamber 69 is a cylindrical tank about 15 feet long. Pressure chamber 69 has a removable top 71 and an air inlet port 73 though its sidewall. Heater elements 21 are suspended from top 71 by hangers 77 that engage hooks 75. The lower ends of hangers 77 engage the U-shaped bends 25. The open ends 26 of heater elements 21 locate near or touch the bottom of chamber 69. Often, some heater elements 21 will be longer than others, and hangers 77 of different lengths may be employed to hang them at positions so that all of the open ends 26 are located near the bottom of chamber 69.

Dielectric liquid 41 is introduced to a level above open ends 26. One dispensing and recovery method employs an external reservoir 79 that has a vent 81. A tube 83 leads from the bottom of reservoir 79 through the sidewall of pressure chamber 69 and to a point near the bottom of pressure chamber 69. A valve 85 in tube 83 is opened to allow dielectric liquid to flow from reservoir 79 into pressure chamber 69. Valve 85 is closed once the selected amount of dielectric fluid 41 is dispensed. Air pressure is then supplied through port 73 for a selected time interval. After removing the air pressure, heater elements 21 are removed from pressure chamber 69 and utilized with other heater assemblies.

Periodically, dielectric liquid 41 needs to be removed from pressure chamber 69 to avoid contamination. Some operators may wish to remove dielectric liquid 41 after each treatment. To do so, prior to bleeding off the air pressure in pressure chamber 69, the operator opens valve 85. The air pressure will push dielectric liquid 41 from pressure chamber 69 up through tube 83 into reservoir 79. After recovering substantially all of dielectric liquid 41, the operator closes valve 85 and bleeds off air pressure from pressure chamber 69.

Although not shown, some heater elements are straight, rather than U-shaped, and have open ends on opposite ends.

These heater elements could be treated by completely immersing them within a pressure chamber such as pressure chamber 69. Pressure chamber 69 could be oriented horizontally, rather than vertical, if desired. Heater elements, other than tubular ones, could also be treated in accordance with FIG. 6. Any type of encased or enclosed heater assembly containing compacted magnesium oxide could be treated in the manner described, including strip and cartridge heater elements.

The invention has significant advantages. The method seals the insulation powder to resist the entry of moisture. The electrical resistance of the powder thus does not deteriorate with time.

While the invention has been shown in only a few of its forms, it should be apparent to those skilled in the art that it is not so limited, but is susceptible to various changes without departing from the scope of the invention.

The invention claimed is:

1. A method for treating electrical insulation powder within a heater element having a metal tube containing an electrical resistance wire that is electrically insulated from the metal tube by the insulation powder, the tube having at least one open end exposing the insulation powder to air, the method comprising:

(a) applying a dielectric liquid under pressure to the open end of the tube to cause some of the liquid to encroach into the insulation powder; then, (b) removing the pressure; wherein:

step (a) comprises applying uncured liquid silicone to the open end; and the method further comprises after step (b), installing the heater element within a heat exchanger while the liquid silicone that encroached within the insulation powder is still uncured.

2. The method according to claim 1, wherein step (a) is performed while the dielectric liquid is substantially at room temperature.

3. The method according to claim 1, wherein step (a) comprises applying liquid silicone under pressure to the open end.

4. The method according to claim 1, further comprising:

placing the heater element within an oven and applying heat to the heater element for a selected duration prior to step (a).

5. A method for treating electrical insulation powder within a heater element having a metal tube containing an electrical resistance wire that is electrically insulated from the metal tube by the insulation powder, the tube having at least one open end exposing the insulation powder to air, the method comprising:

(a) applying a dielectric liquid under pressure to the open end of the tube to cause some of the liquid to encroach into the insulation powder; then.

(b) removing the pressure; and after step (b), removing excess dielectric liquid from the heater element.

6. A method for treating electrical insulation powder within a heater element having a metal tube containing an electrical resistance wire that is electrically insulated from the metal tube by the insulation powder, the tube having at least one open end exposing the insulation powder to air, the method comprising:

(a) applying a dielectric liquid under pressure to the open end of the tube to cause some of the liquid to encroach into the insulation powder; then, (b) removing the pressure;

wherein step (a) comprises:

placing the open end of the heater tube within a chamber;

dispensing the dielectric liquid into the chamber so as to immerse the open end; and pumping gas into the chamber to apply the pressure.

7. A method for treating electrical insulation powder within a heater element having a metal tube containing an electrical resistance wire that is electrically insulated from the metal tube by the insulation powder, the tube having at least one open end exposing the insulation powder to air, the method comprising:

(a) applying a dielectric liquid under pressure to the open end of the tube to cause some of the liquid to encroach into the insulation powder; then, (b) removing the pressure;

wherein the tube is bent into a U configuration and has two of the open ends;

step (a) comprises inserting both of the open ends sealingly through a wall of a chamber, then dispensing the dielectric liquid into the chamber to immerse the open ends; and applying gas pressure to the interior of the chamber.

8. A method for moisture-proofing a heater element having a metal tube containing an electrical resistance wire that is electrically insulated from the metal tube by magnesium oxide powder, the wire being bonded to a conductor pin that protrudes from an open end of the tube, the method comprising:

(a) placing at least the open end of the tube within a chamber;

(b) dispensing into the chamber liquid silicone in a sufficient quantity to immerse the open end of the tube; then (c) pumping a gas into the chamber to a selected pressure and for a selected duration to cause some of the silicone to encroach into the powder through the open end of the tube.

9. The method according to claim 8, further comprising after step (c):

removing the pressure and installing the heater element within a heat exchanger while the liquid silicone that encroached into the powder is still in an uncured condition.

10. The method according to claim 8, wherein step (c) is performed at room temperature.

11. The method according to claim 8, wherein:

the metal tube has a U configuration with two of the open ends;

step (a) comprises placing both of the open ends in the chamber; and step (b) comprises immersing both of the open ends in the liquid silicone.

12. The method according to claim 8, wherein step (a) comprises:

providing a plate with a hole therethrough and mounting a sealed housing to the plate;

inserting the open end of the metal tube through the hole in the plate; and sealing the metal tube to the plate.

13. The method according to claim 8, wherein step (a) comprises:

providing a housing with a base having a hole therethrough;

inserting the open end of the metal tube through a hole in the base; and welding the metal tube to the base; and step (c) comprises sealing the housing and pumping the gas into the housing.

14. The method according to claim 8, wherein step (a) comprises:

providing a plate with a hole therethrough;

inserting the open end of the metal tube through the hole in the plate;

welding the metal tube to the plate; and releasably securing a housing to the plate; wherein step (c) comprises:

sealing the housing and pumping the gas into the housing; and wherein the method further comprises:

detaching the housing from the plate at the conclusion of step (c).

15. The method according to claim 8, wherein step (a) comprises:

placing the entire heater element within the chamber.

16. A method for treating and installing a heater element having a metal tube containing an electrical resistance wire that is electrically insulated from the metal tube by a desiccant powder, the wire being bonded to a conductor pin that protrudes from an open end of the tube;

(a) installing at least the open end of the tube within a chamber;

(b) dispensing into the chamber uncured liquid silicone in a sufficient quantity to immerse the open end of the tube; then (c) applying pressure to the liquid silicone for a selected duration to cause some of the silicone to encroach into the powder through the open end of the tube while maintaining the liquid silicone substantially at room temperature; then (d) mounting the heater element in a heat exchanger while the liquid silicone that encroached into the powder is still in an uncured condition.

17. The method according to claim 16, further comprising after step (c) and before step (d), removing any excess liquid silicone from the open end of the heater element.

18. The method according to claim 17, further comprising dispensing a liquid sealant over the open end and curing the sealant.

19. The method according to claim 17, wherein step (c) comprises pumping a gas into the chamber.

* * * * *